United States Patent [19]

Bodewein

[11] 4,368,837

[45] Jan. 18, 1983

[54] WEB FEED SECTION

[75] Inventor: Jakob Bodewein, Monchen-Gladbach, Fed. Rep. of Germany

[73] Assignee: Jagenberg Werke AG, Düsseldorf, Fed. Rep. of Germany

[21] Appl. No.: 212,927

[22] Filed: Dec. 4, 1980

[30] Foreign Application Priority Data

Dec. 5, 1979 [DE] Fed. Rep. of Germany ..... 2948842

[51] Int. Cl.[3] ..... B65H 17/22

[52] U.S. Cl. ..... 226/176; 226/174; 226/186

[58] Field of Search ..... 226/121, 127–133, 226/176, 177, 181, 186, 154, 155, 187

[56] References Cited

U.S. PATENT DOCUMENTS

| | | | |
|---|---|---|---|
| 3,147,901 | 9/1964 | Nordman et al. | 226/176 |
| 3,490,669 | 1/1970 | Watson | 226/176 |
| 4,029,251 | 6/1977 | Johnson | 226/154 |

*Primary Examiner*—Leonard D. Christian

*Attorney, Agent, or Firm*—Sprung, Horn, Kramer & Woods

[57] ABSTRACT

In a web feed section comprising a bottom feed roll, a top feed roll, and actuator means for adjusting the contact pressure between said rolls, the improvement wherein the actuator means includes a compression spring operatively connected with the top roll through a lever to transmit its force to the top roll, a disk cam for adjusting the initial stress in the spring, and levers for uncoupling the spring from the top roll when a roll is to be replaced.

8 Claims, 2 Drawing Figures

WEB FEED SECTION

BACKGROUND OF THE INVENTION

The invention relates to a web feed section consisting of a bottom roll and a top roll which are adjustable with respect to their contact pressure by means of an actuator.

Feed sections of this type are used in paper- and boxboard-processing machines, for example, and particularly with sheet cutters. The pressure with which the top roll bears on the bottom roll is determined by the weight of the top roll and the force exerted by the actuator. Depending on the direction and magnitude of the force exerted by the actuator, the bearing pressure may be set to be greater than, equal to or smaller than the contact pressure due to the weight of the top roll. The actuator normally takes the form of a hydraulically or pneumatically operated cylinder-piston arrangement. With such an actuator, the direction and magnitude of the force can readily be adjusted. However, the use of feed sections employing such cylinder-piston arrangements as actuators is restricted to sites where compressed air or hydraulic oil is available.

SUMMARY OF THE INVENTION

The invention has as its object to provide a feed section of the type mentioned above which permits the contact pressure of the top roll to be adjusted by purely mechanical means.

In accordance with the invention, this object is accomplished in that the actuator is a mechanical energy-storing device in whose path of force to the top roll a means for reversing the direction of the force may be inserted.

In such a feed section, the top roll may be both loaded beyond its own weight and unloaded with just one energy-storing device. The feed section is completely independent of sources of pneumatic or hydraulic fluids.

A particularly simple energy-storing device is the compression spring. The initial stress in such a compression spring may be adjustable by means of a disk cam. The initial stress is the determinant of the magnitude of the loading or unloading of the top roll.

Suited for transmission of the force of the energy-storing device is a lever. The point of engagement of the lever is preferably formed by a disk cam which is positionable, through a hand lever comprising a dog which acts upon the first lever, in such a way that when the dog engages the first lever the disk cam is released by the energy-storing device. Disk cam and hand lever are preferably coupled to each other through gears.

In order that the effect of the energy-storing device be limited to the path over which it is to load and unload the top roll, and that otherwise it exert no force on the first lever, a stop is provided for the energy-storing device, which is in the form of a compression spring.

Particularly simple decoupling of the first lever from the energy-storing device when the means for reversing the direction of the force is operative is obtained by providing the energy-storing device with two parallel heads, one of which is associated with the first lever and the other with the means for reversing the direction of the force, constructed as a two-armed lever, in such a way that when the two-armed lever is operative the head associated with the first lever is not engaged by the latter.

BRIEF DESCRIPTION OF THE DRAWINGS

The invention will now be described in greater detail with reference to an embodiment illustrated in the accompanying drawing, wherein.

DETAILED DESCRIPTION OF THE INVENTION

Figure 1:
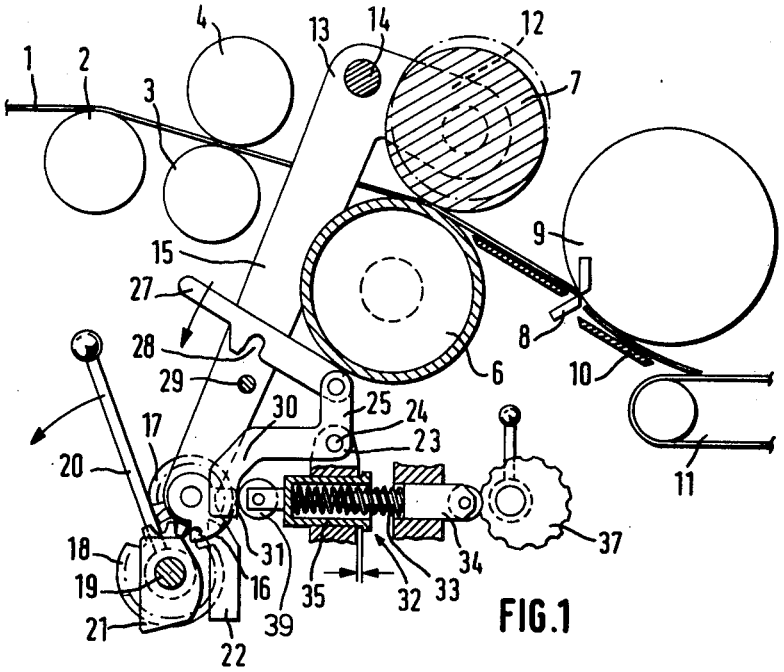
FIG. 1 is a diagrammatic side elevation of the left portion, in the direction of web motion, of a paper-processing machine, and more particularly a sheet cutter, comprising the feed section.
Figure 2:
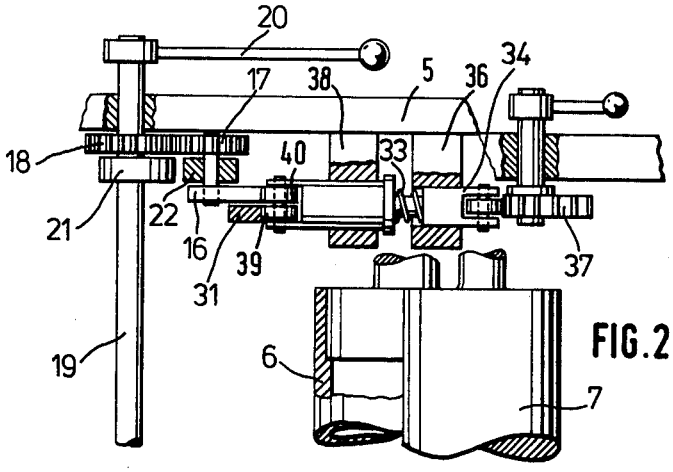
FIG. 2 is a top plan view thereof.

The web 1 passes over a guide roll 2, a lower longitudinal slitter 3 and an upper longitudinal slitter 4 into the reach of a feed section consisting of a bottom roll 6, fixedly mounted in the machine frame 5, and a top roll 7. The feed section 6 and 7, driven by a drive which is not shown, feeds the web 1 to a sheet cutter formed by a fixed lower blade 8 and an upper cutter roll 9. The sheets severed by the sheet cutter 8 and 9 are carried away by a conveyor belt 11.

Each end of the top roll 7 is mounted in a first arm 12 of a first lever 13 which pivots on a fixed point 14 on the machine frame. On the free end of the second arm 15 of said first lever 13 there are mounted for conjoint rotation a disk cam 16 and a gear 17. The gear 17 meshes with a gear 18 adapted to be rotated by a hand lever 20 which pivots on a fixed pin 19. A dog 21 which cooperates with an extension 22 at the free end of the lever arm 15 pivots with the hand lever 20.

A second two-armed lever 23 pivots on a pin 24 which is fixed to the machine frame. Pivotally secured to the free end of one arm 25 of that lever is a lever 27 provided with a notch 28 adapted to accommodate a detent pin 29. The other arm 30 of the second lever 23 has an angled free end 31 which is disposed adjacent to the cam 16 and together with the latter forms points of engagement for an actuator 32.

The actuator 32 consists of a compression spring 33 which bears with one of its ends on an abutment 34 and internally on the bottom of a flanged bushing 35. The abutment 34 is slidably mounted in a guide 36 of the machine frame. Its position is determined by the position of a notched disk cam 37. The flanged bushing 35 is likewise slidably mounted in a guide 38 of the machine frame. On its bottom it is externally provided with two rolls 39 and 40, disposed side by side, which are associated with the cam 16 and the free lever end 31.

The principle of operation of the feed section is as follows.

In the position shown, the thrust of the compression spring 33 is determined by the position of the disk cam 37. The thrust is transmitted through the roll 40 to the cam 16, and hence to the lever arm 15, causing the latter to pivot in a clockwise direction. The bearing pressure of the top roll 7 thus is determined, not by the weight of said roll alone but also by the force of compression spring 33.

In order to raise the top roll 7 to permit the introduction of a new web, the hand lever 20 is pivoted in a counterclockwise direction while the disk cam 37 remains in its position. The cam 16, being coupled to the hand lever 20 through the gears 17 and 18, thus moves out of contact with the roll 40. The flanged bushing 35 then comes to abut by its flange on the guide 38. The lever 13 thus is no longer loaded with the force of the compression spring 33. As the hand lever 20 continues its pivoting movement, the dog 21 comes to bear on the extension 22, thus causing the lever 13 to pivot in a counterclockwise direction and to lift the top roll 7 off the bottom roll 6.

As the hand lever 20 is returned to its starting position, the sequence is reversed. When the cam 16 is once more in contact with the roll 40, the force of the compression spring 33 is effective as before.

In order to reduce the bearing pressure of the top roll 7 by partly neutralizing its weight, the notched lever 27 is manually pivoted and the notch 28 is caused to engage the detent pin 29. The sides of the notch 28 are designed so that as the notch engages the detent pin the free end 31 of the lever 23 comes to abut on the roll 39 while the roll 40 is barely out of engagement with the dog 31. The thrust exerted by the compression spring 33 is deflected by the lever 23 and thus acts on the arm 15 of the first lever 13 so as to pivot it in a counterclockwise direction, which has the effect of lightening the top roll 7.

The principle of operation in lifting the top roll 7 off the bottom roll 6 by pivoting the hand lever 20 is the same as described. However, lifting is supported by the action of the compression spring 33 until the flange of the flanged bushing 35 abuts associated guide 38.

It will be appreciated that the elements illustrated and described on one side of the feed section are provided on both sides thereof, and that the elements which are to be actuated manually are ganged together.

The feed section described makes it possible to set a given bearing pressure and to store it. The feed section can be supplementally loaded or unloaded by means of just one mechanical energy-storing device. Raising of the top roll is accomplished by moving a single lever. Similarly, the change-over from supplementary loading to unloading is effected by moving just one lever. For these reasons, the feed section in accordance with the invention constitutes a structurally simple, readily operated unit suited for replacement of a hydraulically or pneumatically operated feed section.

It will be appreciated that the instant specification and claims are set forth by way of illustration and not of limitation, and that various changes and modifications may be made without departing from the spirit and scope of the present invention.

What is claimed is:

1. In a web feed section comprising a bottom feed roll, a top feed roll, and actuator means for adjusting the contact pressure between said rolls, the improvement wherein the actuator means includes a mechanical energy-storing device and means for reversing the direction of the force of said energy-storing device, said reversing means operatively connecting the energy-storing device with one of said rolls.

2. A web feed section according to claim 1, wherein the energy-storing device is a compression spring.

3. A web feed section according to claim 2, including a disk cam for adjusting the initial stress in the compression spring.

4. A web feed section according to claim 1, wherein the actuator means includes a first lever for transmission of the force of the energy-storing device.

5. A web feed section according to claim 4, including a disk cam, a hand lever and a dog, the disk cam forming the point of engagement of the first lever for adjusting the contact pressure between the rolls, the dog acting upon the first lever, the hand lever being connected to the dog and to the disk cam so that when the dog engages the first lever the disk cam is released from the energy-storing device.

6. A web feed section according to claim 5, including a gear connecting the disk cam with the hand lever.

7. A web feed section according to claim 4, wherein the energy-storing device includes two parallel heads one of which is associated with the first lever and the other with the means for reversing the direction of the force, and a two-armed lever operatively coupling the heads with one of the rolls in such a way that when the reversing means is operative that head which is associated with the first lever does not make contact therewith.

8. A web feed section according to claim 2, including a stop for limiting the movement of the compression spring during inactivation.

* * * * *